US006241387B1

(12) United States Patent
Will

(10) Patent No.: US 6,241,387 B1
(45) Date of Patent: Jun. 5, 2001

(54) X-RAY SYSTEM CEILING SUPPORT WITH A DECOUPLABLE TOMOGRAM DRIVE

(75) Inventor: Thomas Will, Kemnath (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/379,403

(22) Filed: Aug. 24, 1999

(30) Foreign Application Priority Data

Aug. 25, 1998 (DE) ..... 198 38 594

(51) Int. Cl.[7] ..... H05G 1/02

(52) U.S. Cl. ..... 378/197; 378/193; 74/89.17; 74/405; 74/422

(58) Field of Search ..... 378/193, 197, 378/189, 167, 168, 21, 38, 39; 310/75 R; 74/89.17, 405, 422

(56) References Cited

U.S. PATENT DOCUMENTS 3,770,955 * 11/1973 Tomita et al. .
3,934,852 * 1/1976 Weber et al. ..... 254/420
4,872,192 10/1989 Hahn et al. .
5,048,070 9/1991 Maehama et al. .
5,793,837 * 8/1998 Mezhinsky et al. ..... 378/38

FOREIGN PATENT DOCUMENTS 87 05 534 U 8/1987 (DE) .

* cited by examiner

*Primary Examiner*—David P. Porta
(74) *Attorney, Agent, or Firm*—Schiff Hardin & Waite

(57) ABSTRACT

A ceiling support for an X-ray source with a decouplable tomogram drive, has a transverse carriage suspended so as to be displaceable along a longitudinal ceiling running rail with the tomogram drive. The tomogram drive has a driven gearwheel on the drive shaft of a drive motor which is rigidly secured to the transverse carriage. The tomogram drive has a displacement gearwheel that meshes therewith and that is seated on a rocker which is pivotable around the drive shaft. The rocker can be pivoted by a switchable drive element into engagement with a toothed rack secured to the longitudinal ceiling running rail.

8 Claims, 3 Drawing Sheets

X-RAY SYSTEM CEILING SUPPORT WITH A DECOUPLABLE TOMOGRAM DRIVE

BACKGROUND OF THE INVENTION

1. Field of the Invention

The present invention is directed to an X-ray system ceiling support with a decouplable tomogram drive, of the type having a transverse carriage suspended at a longitudinal ceiling running rail moved so as to be displaceable along the longitudinal ceiling running rail together with the tomogram drive.

2. Description of the Prior Art

During operation of an X-ray apparatus having such a ceiling support (from which a component, such as an x-ray source or an X-ray source/detector combination, is suspended), there is the necessity of being able to manually undertake an optimally easy displacement of the ceiling support (and the component suspended therefrom) during normal operation. For operation in a mode for producing a tomogram, a tomogram drive with a toothed belt solution is known wherein the transverse carriage is driven with two toothed belts that proceed parallel to each other. Given manual displacement of the support, the motor is separated (decoupled) from the toothed belt drive train by a magnetic clutch, so that the support can be moved. A disadvantage of this known system is that since the belt remains engaged with the carriage, the manual displacement forces are increased by the required belt tension, and the image quality of the tomograms is negatively influenced by stretching of the toothed belt which occurs during manual displacement, which makes driving via the belt less precise in the tomogram mode.

SUMMARY OF THE INVENTION

An object of the present invention is to provide an X-ray source ceiling support with a decouplable tomogram drive of the type initially described which can be simply manufactured and can be simply and dependably actuated during operation, and which requires minimal manual displacement forces and enables error-free tomograms.

For achieving this object, the inventive tomogram drive has a driven gearwheel on the driven shaft of a drive motor rigidly secured to the transverse carriage, and a displacement gearwheel that meshes therewith and that is seated on a rocker that is pivotable around the driven shaft, whereby the rocker can be pivoted by a switchable drive element in engagement with a toothed rack secured to the ceiling, preferably the longitudinal ceiling running rail.

By simply pivoting the rocker in and out, the drive connection between the displacement gearwheel and the toothed rack can be produced and in turn released, so that the coupling and decoupling of the tomogram drive requires only a very simple and inexpensive structure.

The switchable drive element is preferably a lifter magnet that moves a sensing wheel against the rocker and thereby pivots this wheel against the toothed rack.

In an embodiment of the invention, the rocker, after the complete engagement of the displacement gearwheel into the toothed rack, is automatically locked in this engaged position, which can in turn be very simply realized by providing a detent of the rocker, for example a lateral edge of a plate that forms the rocker and carries the displacement gearwheel, which actuates a switch in the engaged position of the displacement gearwheel into the toothed rack, this switch actuating a lock element for the rocker. The lock element can thereby be a plate that can be displaced into and out of the return pivot path by a second lifter magnet that is biased into the release position for the rocker by a spring.

The decoupling is dependably assured by biasing the rocker into the decoupling position by spring, so that, given the absence of a lock by the plate and with the drive element (first lifter magnet) turned off, it is moved into the decoupling position by a brief rotation of the motor and the gearwheel turns out of the toothed rack as a result thereof. In order to prevent engagement of the tomogram drive from failing due to, when pivoting the rocker against the toothed rack, a tooth of the displacement gearwheel striking a tooth of the toothed rack, in a further embodiment of the invention the switchable drive element is coupled to the drive motor such that, when it is actuated, the drive motor starts in a direction, causing the displacement gearwheel to mesh into the toothed rack until full engagement, and the drive motor can be switched off by the switch that actuates the lock element for the rocker or by the second lifter magnet after the fully engaged position is reached. This initial startup of the drive motor is thus only provided for assuring the complete engagement of the displacement gearwheel into the toothed rack. For actually moving the transverse carriage, it must then be re-engaged into the desired travel direction. This can be assured most simply and dependably by providing two switches of which one is the one on/off switch which effects the coupling and uncoupling of the tomogram drive in order to monitor whether the rocker is locked in the position in the toothed rack by the second magnet, and the other switch stops the motor rotation given the pivot-in event, or starts the motor rotation given the pivot-out event.

DESCRIPTION OF THE PREFERRED EMBODIMENTS

Figure 1:
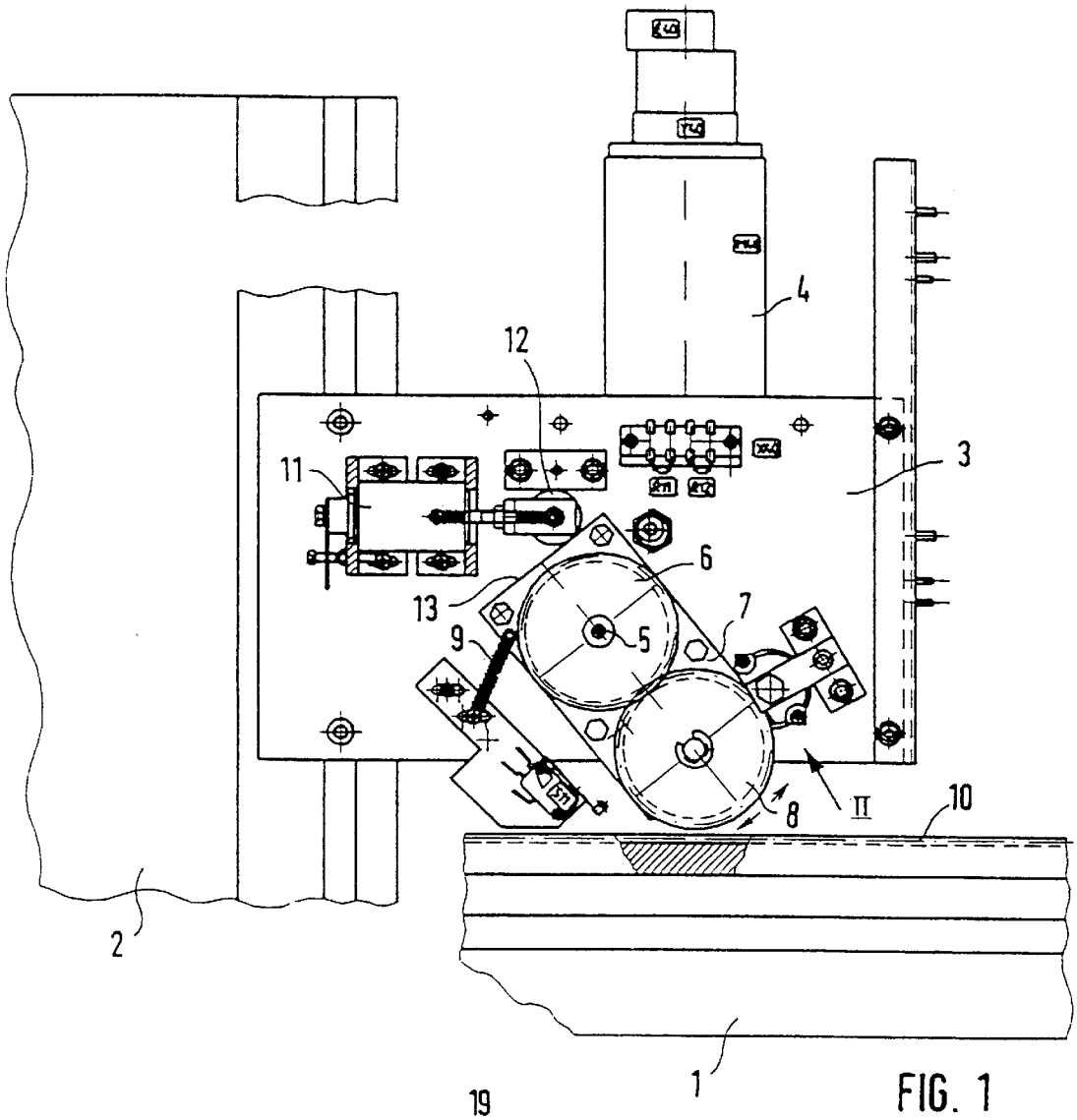
FIG. 1 is a top view of an inventive drive, wherein the rocker is shown in the pivoted-out, decoupled position.

In the FIGURES, a longitudinal ceiling running rail movably suspends (using rollers that are not shown) a transverse carriage 2 carrying an X-ray source ceiling support (likewise not shown). A plate 3 that carries the decouplable tomogram drive is rigidly secured to the transverse carriage 2. This tomogram drive includes a drive motor 4 having a drive shaft 5 (redirected via a gearing under the plate 3) on which a driven gearwheel 6 is seated. A plate forming a rocker 7 is pivotably seated on the drive shaft 5, a second displacement gearwheel 8 that meshes with the driven gearwheel 6 of the drive motor 4 is rotationally mounted on the rocker 7. In the decoupled position of the drive shown in FIG. 1, the rocker 7 is pivoted by a spring 9 into a position wherein the displacement gearwheel 8 is disengaged from a toothed rack 10 laterally attached to the longitudinal ceiling running rail 1.

Figure 2:
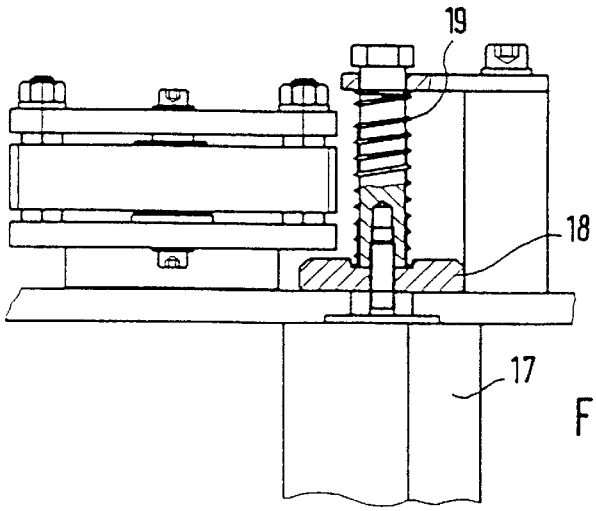
FIG. 2 is a view of the rocker and its lock mechanism as seen in the direction of the arrow II in FIG. 1.
Figure 3:
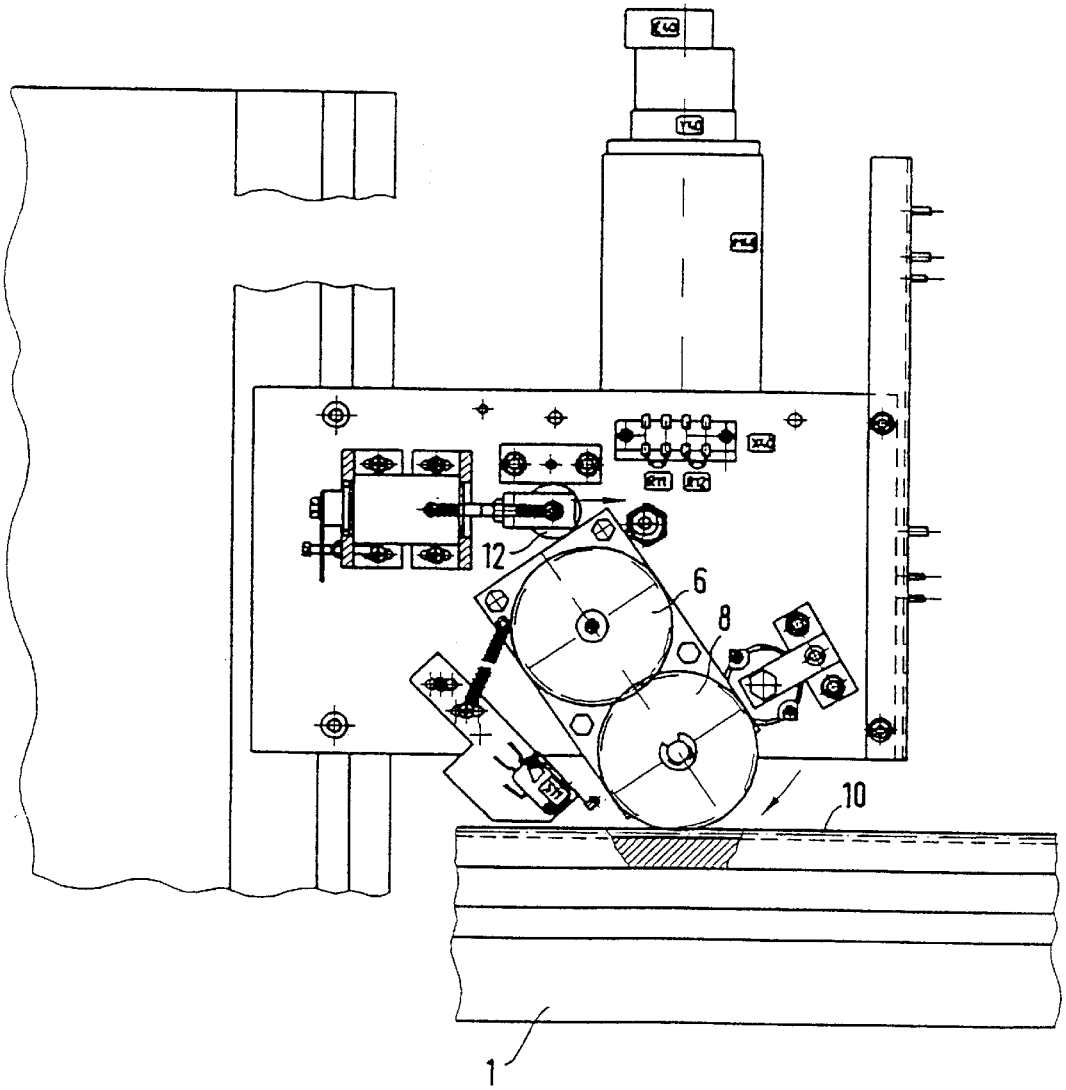
FIG. 3 is a view corresponding to FIG. 1, wherein the first lifter magnet has pivoted the rocker against the toothed rack.
Figure 4:
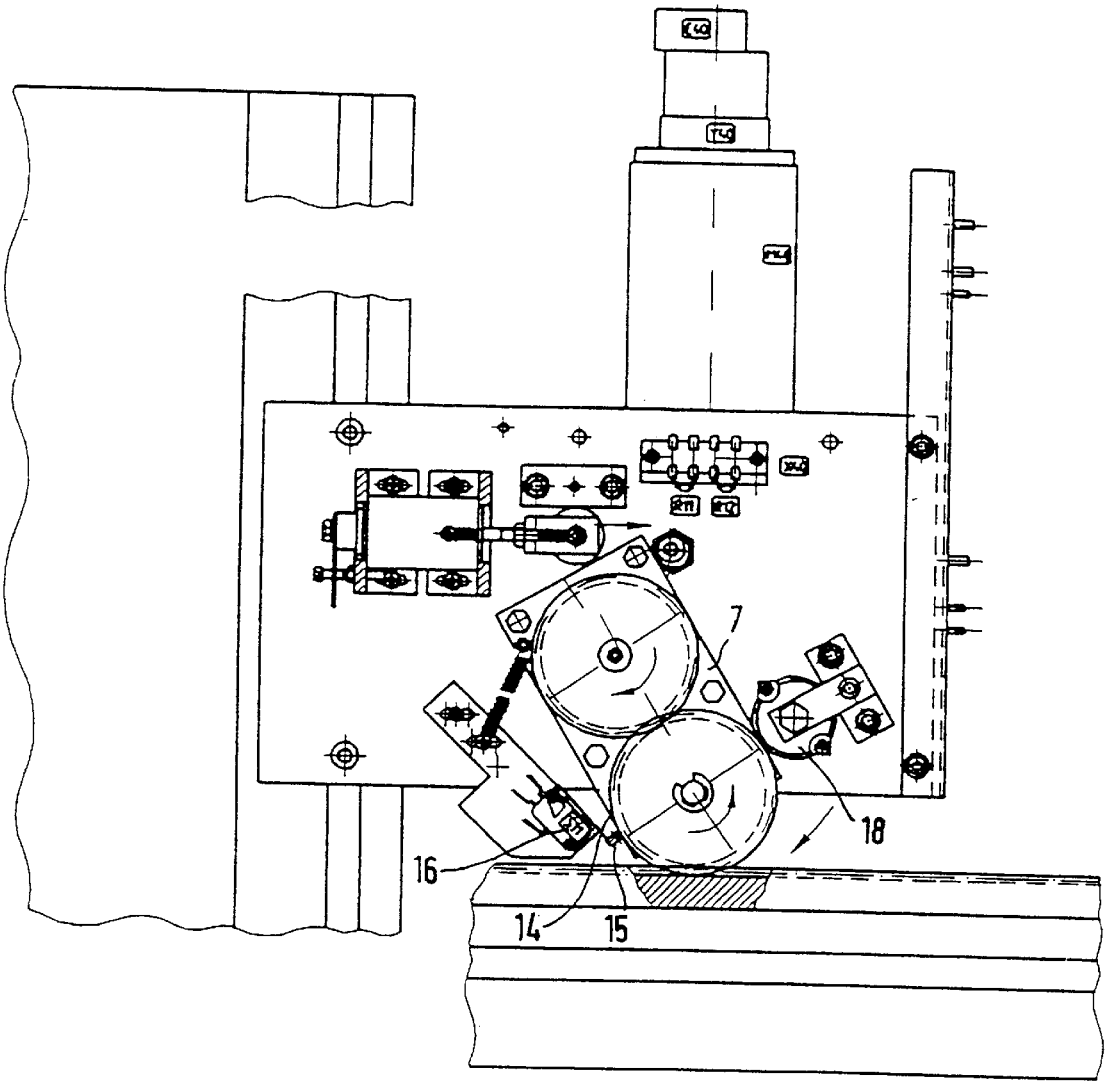
FIG. 4 is a view corresponding to FIG. 3, wherein the displacement gearwheel has meshed completely into the toothed rack due to the rotation of the motor.
Figure 5:
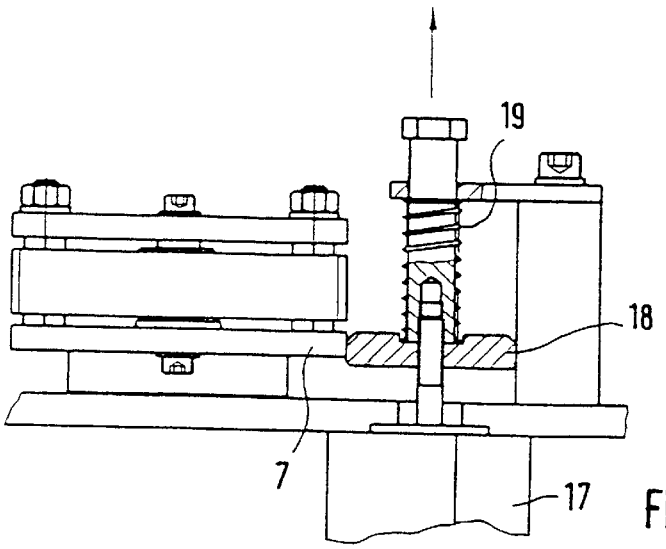
FIG. 5 is a side view of the rocker with the lock element, now pivoted into locking position.

For coupling the tomogram drive, a sensing wheel 12 is displaced against the edge 13 of the rocker 7 via a first lifter magnet 11 and thereby rotates the rocker 7 toward the toothed rack 10 (FIG. 2). The drive motor 4 is also turned on at the same time as this motion, so that the rotating of the displacement gearwheel 8 assures that this gearwheel 8 can completely mesh into the toothed rack 10. When this completely engaged position has been reached, as shown in FIG. 4, the edge 14 of the rocker 7 serving as detent strikes against the key 15 of a switch 16 that actuates a second lifter magnet 17 that displaces a lock element 18, fashioned as a plate, into the return pivot path of the rocker 7 (FIG. 5) and thereby prevents the rocker 7 from pivoting back. The drive motor 4 is turned off at the same time. The tomogram drive is thus in the coupled position and, after selecting the tomogram mode, it is possible to place the transverse carriage into motion in one or other direction with the tomogram drive. The brief-duration activation of the drive motor 4 for the purpose of complete engagement of the displacement gearwheel 8 on the rocker 7 ensues automatically after the activation of a separate switch for coupling and decoupling the tomogram drive, as described in detail, of course, above.

Although modifications and changes may be suggested by those skilled in the art, it is the intention of the inventor to embody within the patent warranted hereon all changes and modifications as reasonably and properly come within the scope of his contribution to the art.

I claim as my invention:

1. A ceiling support for an X-ray system with a decouplable tomogram drive, comprising:

a ceiling rail adapted for mounting at a ceiling;

a transverse carriage suspended from said ceiling rail so as to be movable along said ceiling rail; and a tomogram drive comprising a drive motor rigidly secured to said transverse carriage, said drive motor having a drive shaft with a driven gearwheel mounted thereon, a rocker which is rotatable around said drive shaft, a displacement gearwheel mounted on said rocker and meshing with said driven gearwheel, a toothed rack associated with said ceiling rail, and a switchable drive element engageable and disengageable with said rocker to rotate said rocker around said drive shaft to engage said displaceable gearwheel with said toothed rack.

2. An X-ray system ceiling support as claimed in claim 1 further comprising a spring connected between said rocker and said transverse carriage for biasing said rocker arm to disengage said displacement gearwheel from said toothed rack, and wherein said switchable drive element comprises a lifter magnet which moves said rocker against a spring force exerted by said spring.

3. An X-ray system ceiling support as claimed in claim 1 further comprising a locking arrangement which locks said rocker in an engaged position after said displacement gearwheel is positively engaged with said toothed rack.

4. An X-ray system ceiling support as claimed in claim 3 wherein said locking arrangement comprises a displaceable lock element, a switch which activates said lock element, and a detent on said rocker which actuates said switch, movement of said rocker causing said detent to actuate said switch to displace said lock element to lock said rocker in said engaged position.

5. An X-ray system ceiling support as claimed in claim 4 wherein said rocker executes a movement path into said engaged position, and wherein said locking arrangement further comprises a lifter magnet and wherein said lock element comprises a plate displaceable by said lifter magnet into and out of said movement path of said rocker.

6. An X-ray system ceiling support as claimed in claim 5 wherein said lock arrangement further comprises a spring which normally biases said lock element into a release position out of engagement with said rocker.

7. An X-ray system ceiling support as claimed in claim 1 wherein said switchable drive element is coupled to said drive motor so that, upon actuation of said switchable drive element, said drive motor is energized to cause said displacement gearwheel to rotate into full engagement with said toothed rack, and further comprising means for switching off said drive motor after said displacement gearwheel and said toothed rack are fully engaged.

8. An X-ray system ceiling support as claimed in claim 7 wherein said switchable drive element comprises means used exclusively for operating said drive motor to engage and disengage said displaceable gearwheel with said toothed rack, and further comprising a switch element used exclusively for turning said drive motor on and off for operation in a tomogram mode after said displacement gearwheel is fully engaged with said toothed rack.

* * * * *